United States Patent [19]

Dyar

[11] Patent Number: 5,003,716

[45] Date of Patent: Apr. 2, 1991

[54] FLEXIBLE OUTDOOR FLIP SIGN DISPLAY

[76] Inventor: Royce M. Dyar, P.O. Box 82, Locust Fork, Ala. 35097

[21] Appl. No.: 315,797

[22] Filed: Feb. 27, 1989

[51] Int. Cl.[5] ..... G09F 11/02

[52] U.S. Cl. ..... 40/503; 40/502; 40/504; 40/505; 40/603

[58] Field of Search ..... 40/503, 504, 505, 506, 40/502, 603, 604, 493, 499; 160/236, 188, 218

[56] References Cited

U.S. PATENT DOCUMENTS

| | | | |
|---|---|---|---|
| 1,256,645 | 2/1918 | Barnett | 40/505 |
| 1,366,548 | 1/1921 | Willison et al. | 40/505 |
| 2,252,764 | 8/1941 | Farrell | 40/604 |
| 3,273,271 | 9/1966 | Werner | 40/502 |
| 3,304,638 | 2/1967 | Grandell et al. | 40/505 |
| 3,307,170 | 2/1967 | Tetsuo Aoyama et al. | 40/505 |
| 3,313,131 | 4/1967 | Werner | 40/505 |
| 3,367,049 | 2/1968 | Noreen | 40/505 |
| 3,383,785 | 5/1968 | Werner | 40/505 |
| 4,015,349 | 4/1977 | Dunne | 40/505 |

*Primary Examiner*—Peter R. Brown
*Assistant Examiner*—Brian Green
*Attorney, Agent, or Firm*—Jennings, Carter, Thompson & Veal

[57] ABSTRACT

A flip-type display sign having a plurality of parallel louvers mounted in a frame utilizes flexible fabric louver covers to define the faces of the louvers, with the louver covers being supported on a plurality of cables, extending between a pair of end caps held in spaced relation by a lightweight tubular frame. The fabric covers may be independently removed or replaced or may be internally illuminated.

13 Claims, 3 Drawing Sheets

FIG. 5
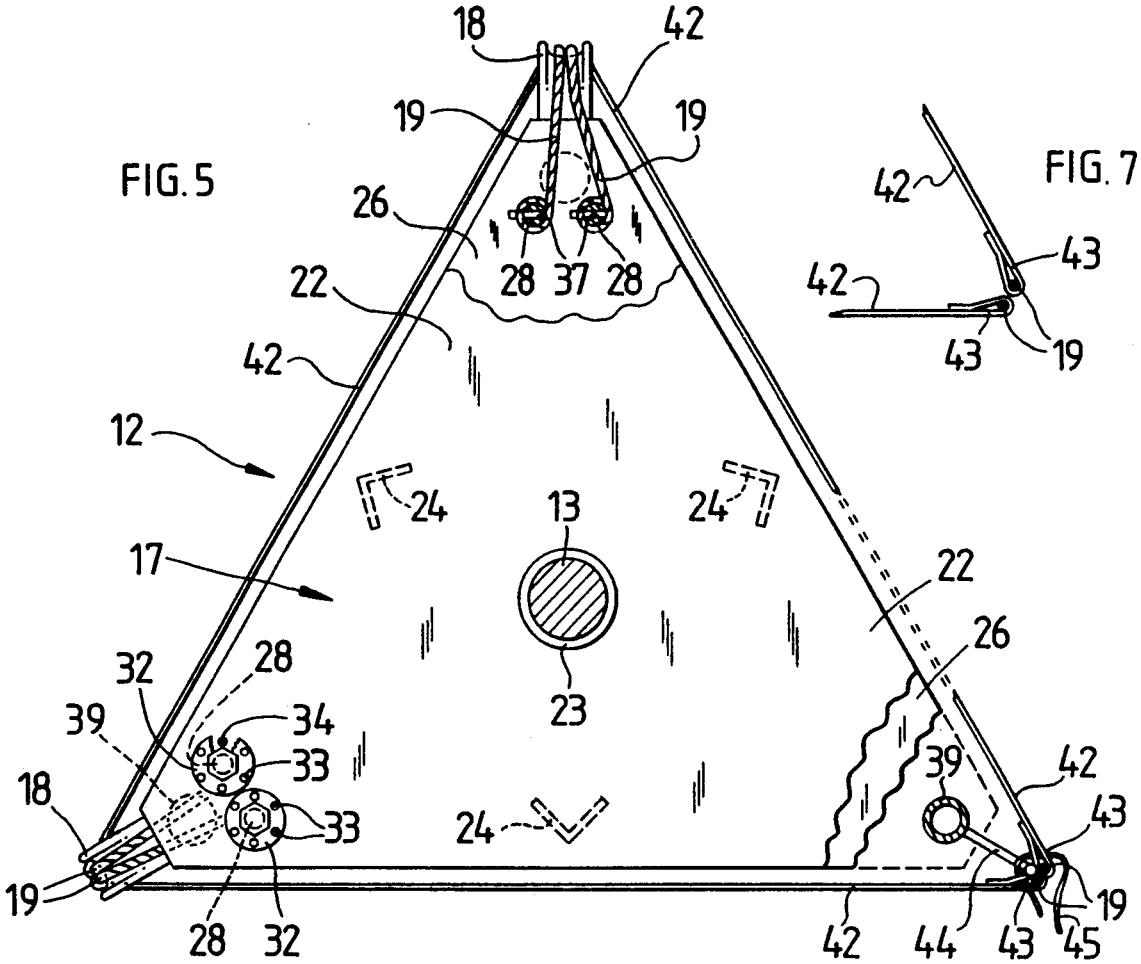
FIG. 7
FIG. 6
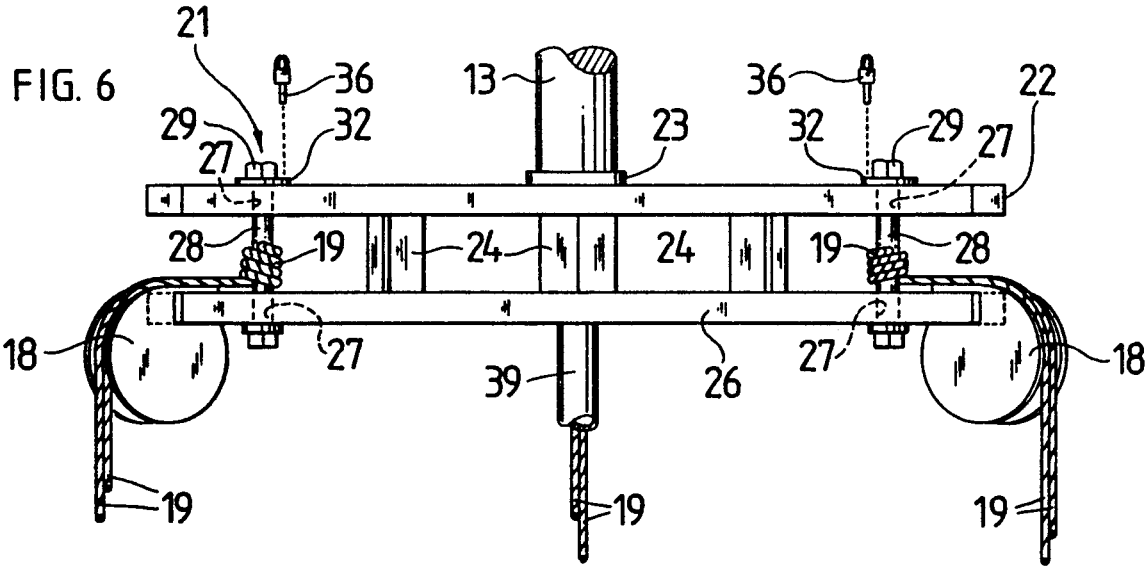

FLEXIBLE OUTDOOR FLIP SIGN DISPLAY

FILED OF THE INVENTION

The present invention relates to outdoor advertising and more particularly to outdoor advertising of the billboard type. In even greater particularity, the present invention relates to flip type billboards, that is, billboards wherein the picture elements are composed of a plurality of vertical or horizontal strips mounted for rotation about an axis such that rotation of the strips about the axis presents a new display to be seen. More particularly the present invention may be described as a flip type billboard wherein the individual panels or faces used in displaying the advertisement are made from a flexible material which can be separately mounted and removed from the billboard display.

BACKGROUND OF THE INVENTION

Billboards which utilize rigid one-piece louvers as elements of their display, wherein the louvers rotate about a longitudinal axis to display one of three faces which are painted to provide a different display have been known for the last twenty-five years. Nonetheless such billboard displays leave something to be desired. The primary problem with such displays is that they are made of a rigid material, therefore they are difficult to install and maintain. One type of such display uses a solid triangular member which can only be painted while mounted on a sign. Therefore during periods of inclement weather the billboard display cannot be changed. In another type billboard rigid individual faces can be detachably affixed to the core of the louver such that the rigid faces may be removed from the louver and transported to the plant for in-plant painting, however such louvers may be up to thirty-two feet in length and thus these rigid faces, although in theory removable and transportable, are indeed difficult to remove and transport in their rigid form. Consequently, considerable effort is required to maintain and change the sign faces. Additionally the metallic structure used in the prior art louvers has a considerable mass, therefore set-up of the flip signs using the rigid louvers entails a considerable effort. Yet another concern present in the prior art louvers with detachable faces is that the faces may become detached from the core of the louver during periods of high wind and the like and thus present a sheet of aluminum or other metal which may fall on passing motorists or pedestrians with deleterious results.

SUMMARY OF THE INVENTION

It is the object of the present invention to construct a flip-type billboard display which can be easily changed and maintained.

Yet another object of the invention is to construct a display of the above-described type which is lightweight and economical, both in fabrication and maintenance.

Yet another object of the invention is to provide a display of the above-described type which does not represent a hazard to motorists or pedestrians due to unexpected detachment of its component parts.

Yet another object of the invention is the provision of a display of the above-described type wherein the faces of the display may be easily changed by a single workman in a fraction of the time required to change the face of a conventional flip-type display.

Yet another object of the invention is to provide a flip-type billboard display which can have its faces painted at a remote location and then readily transported to the display site for positioning on the display.

Still another object of the invention is to provide a flip sign which can be easily internally lighted to enhance the appearance of the display.

These and other objects of my invention are advantageously accomplished in my novel construction which is not limited by the rigid elements used in the prior art. In fact, the use of lightweight elements in the construction of my displays allows me to build larger and more effective displays at a substantial savings of both time and manpower. Certain elements of the prior art are, of course, incorporated in my design in as much as the basic structure of a flip billboard is retained. That is to say, the supporting members which elevate the billboard above the ground or floor remain the same and the framing elements are essentially the same in that the outer dimensions of the billboard are defined by a rigid frame. Also, the mechanism for rotating the individual elements comprising the display may be conventional in structure and function. The novelty of the present invention resides in the utilization of a lightweight structural combination which is easily fabricated, erected and maintained. Each structural element is conventionally mounted in the rigid frame of the display and is engaged by the turning mechanism for proper alignment or rotation, however, the actual structure of the individual elements is radically different from the prior art. Each element has a pair of stub shafts which extend into opposite frame members such that the element is supported at each end on the stub shafts. One of the stub shafts is adapted for engagement with the turning mechanism while the other stub shaft remains free to rotate within an aperture in the frame. Intermediate the stub shafts and holding the stub shafts in spaced relation is an elongated boom-like structure made of a plurality of lightweight tubular members which extend across the length of the frame and are braced to one another by shorter tubular members thus the stub shaft and boom form a lightweight base upon which faces of the display elements may be supported. Each stub shaft also has mounted thereon a supporting member which supports a plurality of inelastic cables which run the length of the intermediate boom and are drawn tight in spaced relation to the periphery of the boom such that a pair of cables are supported at each of three corners spaced radially from the stub shaft and aligned with three like corners spaced radially from the stub shaft at the other end of the boom. A flexible canvas or fabric-like panel is supported on the cables to define three faces of the display element, each face being equal in length and width and extending between the cables and across the width of the billboard display. Each fabric panel is supported on two of the cables which are in turn supported on adjacent corners of the triangular pattern, and each panel may be easily removed from its supporting cables and returned to the plant for repainting or reconditioning. Likewise new panels may be easily placed on the billboard display simply by disconnecting the cables at one end and slipping new flexible panels onto the cable which are reattached attached and properly tensioned. In this manner a single workman may easily change a sign display in far less time than would be required for numerous workmen to change the display in a conventional rigid louvered flip display sign.

BRIEF DESCRIPTION OF THE DRAWINGS

Apparatus embodying features of my invention are depicted in the accompanying drawings which form a portion of this application and wherein:

FIG. 5 an end view of one of the display elements shown partly in section and partly broken away to display its constituent parts;

FIG. 6 is a side elevational view of the end cap shown in FIG. 5 partially in section; and FIG. 7 is a detailed view partially in section of the junction of a pair of fabric panels as supported on adjacent cables.

DESCRIPTION OF A PREFERRED EMBODIMENT

Figure 1:
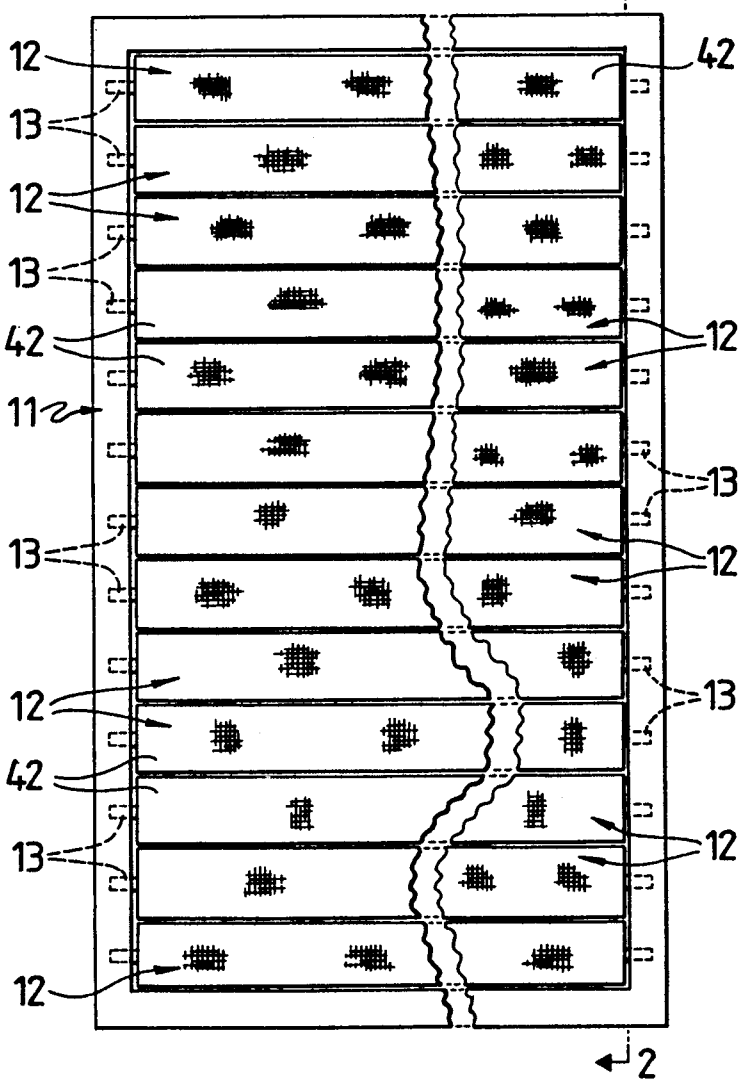
FIG. 1 is a front elevational view of a billboard structure wherein a plurality of flip elements are aligned horizontally within a frame.
Figure 2:
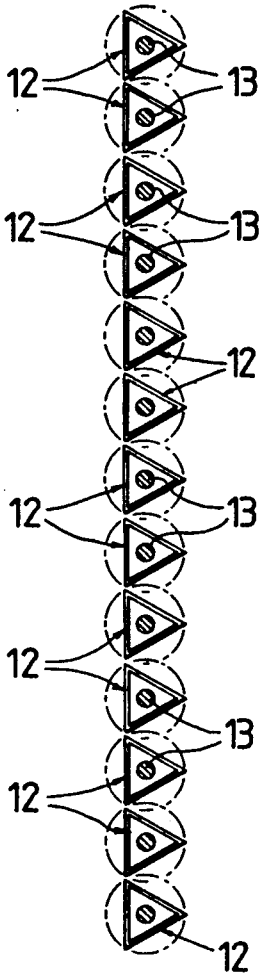
FIG. 2 is a sectional view of the apparatus shown in FIG. 1 taken on the line 2—2 of FIG. 1.
Figure 3:
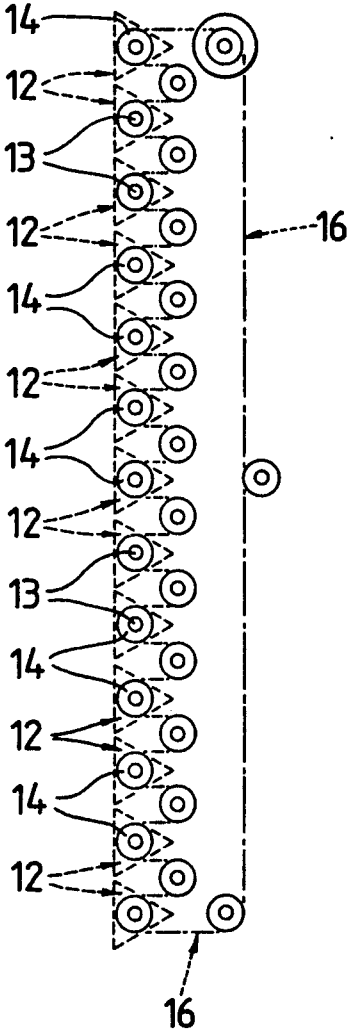
FIG. 3 a schematic view exemplary of the drive mechanism required to rotate the individual elements of the display as shown in FIG. 1 or FIG. 2.

Referring to the drawings for a clearer understanding of my invention, it may be seen in FIGS. 1-3 that I have retained certain traditional features in my overall flip sign such that my signs may be utilized in exactly the same manner as conventional signs but are more economical to fabricate, erect, and maintain. As may be seen in FIGS. 1 & 2, I utilize a rigid frame 11 which is typically made from structural steel for large billboards and the like, and within which are mounted a plurality of display elements 12. These elements are supported on stub shafts 13 as shown in FIGS. 1-4, the stub shafts 13 being mounted in appropriate bearings in frame 11 and having one end adapted with a sprocket 14 or sheave to receive a drive chain 16 or belt such that the display element 12 may be rotated concomitantly to expose one of the three faces of the element 12. The mechanism for the elements 12 may be an electric motor which drives a chain, a set of belts, or a worm gear to turn the stub shafts 13, all as is well understood in the art.

Figure 4:
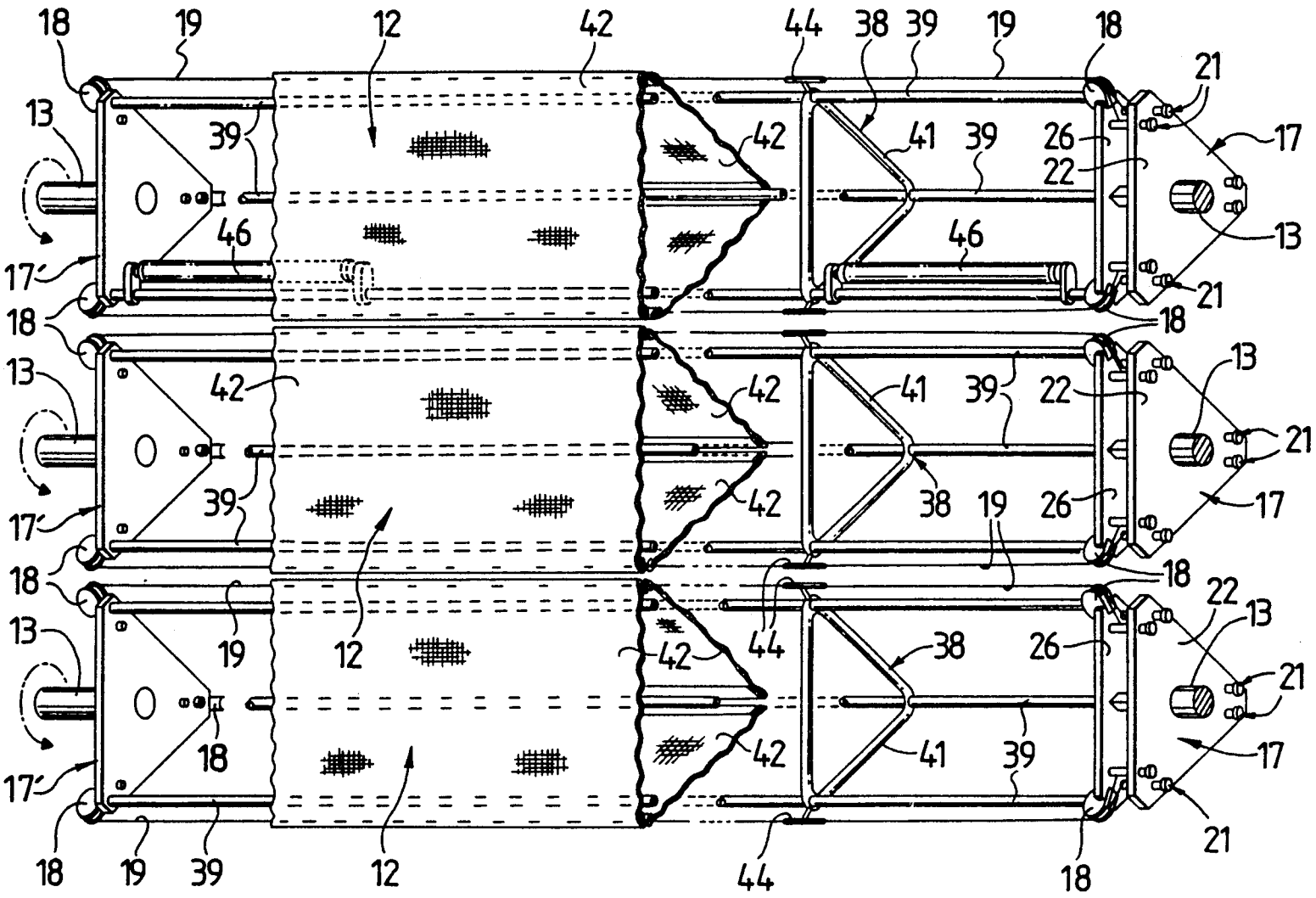
FIG. 4 a perspective view of a plurality of the display elements shown partially broken away to expose their constituent members and partially in section with the frame elements removed for clarity.

In marked contrast to the prior art, however, my display elements 12 utilize a novel construction whereon each stub shaft 13 carries an end cap 17 as is shown most clearly in FIGS. 4-6. The end caps 17 as shown in the drawings are essentially triangular, however, it should be understood that they could be of any shape which will support a plurality of cable guides 18 which are spaced at (he corners of an equilateral triangle. Each cable guide 18 supports a pair of cables 19 which are supported between the end caps 17. As may be seen, the cable guides 18 are rigid and are carried on the end caps 17 such that all of the cables 19 are supported in parallel and define three intersecting equilateral planes about the axis of the stub shafts 13. The cables 19 are affixed to one of the end caps, designated as 17', by any convenient means of attachment which will hold one end of the cable 19 securely. The other end of the cable 19 is attached to a windlass 21 formed in end cap 17 which may be rotated to tighten or loosen the cable 19 to the desired tension. Thus end caps 17 will be made with a plate member 22 secured to the stub shaft 13 by welding or with a hub 23. The plate member 22 carries a plurality of spacers 24 which may be angle iron and which position a guide support member 26 parallel to the plate member 22. The guide support member 26 may also be a plate-like member or may be an open rigid triangular frame which supports the cable guides 18. A plurality of holes 27 are formed in the plate member 22 and guide support member 26 intermediate the cable guides 18 and the axis of the stub shafts 13, with the holes being aligned in pairs such that a rotatable bolt or pin 28 may be inserted therethrough parallel to the stub shafts 13. Each pin 28 has a head 29 and associated nut 31 thereon outwardly of the plate member and guide support member such that the pin 28 is loosely secured in the holes 27. Note that the pin 28 is not threaded. The pin 28 also carries an annular flange 32 proximal the plate member 22. The flange 32 has a plurality of apertures 33 therein which are in a circle about the pin 28 which can come into alignment with an aperture 34 in plate member 22. When the apertures are aligned, a locking pin 36 may be inserted therein to hold the windlass stationary. Of course a locking ratchet or the like may be substituted for the locking pin arrangement. Each pin 28 also has a transverse bore 37 therethrough in which an end of cable 19 may be received, such that the pins 28 each serve as a lockable windlass for each cable 19 supported on the end caps 17 and 17'.

The end caps 17 and 17' are held in position relative to each other by a rigid lightweight tubular frame 38 having a plurality of rigid tubular members 39 extending in parallel between the end caps 17, 17' and a plurality of tubular braces 41 interconnecting the tubular members 39. Note that the tubular frame 38 is shown as triangular in the drawings, however a different geometry may be employed as long as the tubular frame does not extend to the faces defined by the cables 19, because each face will be further defined by a flexible fabric panel 42 carried by a set of cables 19 on adjacent cable guide 18. As may be seen in FIG. 7, each panel 42 will have a lateral sleeve 43 formed on each edge to receive a cable 19 therethrough and as seen in FIG. 1 will extend the full length of the elements 12. A set of intermediate cable supports 44 are carried by the tubular frame 38 and extend toward the edges of the panels 42. With the panels 42 supported on the cables 19, the cables 19 can be attached to these T-shaped supports or teespacers 44 by using a thread 45 passing through the fabric panels and around the cables 19 and supports. Note also that the fabric panels 42 allow some light transmission, thus a set of fluorescent lamps 46 may be mounted to the tubular frame 38 to provide internal illumination of the panels 42. The lamps 46 would be connected to a conventional rotary contact to receive electrical power from the same source as the mechanism motor that turns the display elements and could be provided with a photo-electric circuit that controlled the illumination of the sign only at night or low light periods.

The foregoing description is by no means inclusive of all the variations comprehended within the scope of may invention, however it serves to illustrate the advantageous combination of features found in my invention. For example, the ability to use a flexible fabric-like panel greatly facilitates the maintenance and construction of the signs. In the prior art with detachable rigid panels, the panels required a trailer and more than one person to transport and install, whereas in the instant invention each fabric panel may be removed or installed by one person, detaching the cables 19 from the end cap 17 and sliding the panels 42 onto or off of the cables 19. The panels 42 can be folded for transport and can be handled by one person. Thus, the panels can be painted and installed at the convenience of the workman without worry about weather or transportation or labor availability.

While I have shown my invention in one form, it will be obvious to those skilled in the art that it is not so limited but is susceptible of various changes and modifications without departing from the spirit thereof.

What I claim is:

1. A trihedral member for use in a flip-type advertising sign wherein a plurality of such members in parallel alignment in a rigid frame structure form an advertising display which may be changed by simultaneously rotating each member of said plurality with a common means for turning, comprising, in combination:

(a) a first end cap and a second end cap mounted for selective driven rotation about a common axis normal thereto;

(b) means mounted intermediate said first end cap and said second end cap for holding said end caps in rigid spaced relation for concomitant driven rotation;

(c) a plurality of inelastic cable members connected between and supported by said end caps;

(d) means supported on said end caps for tensioning said cable members;

(e) a plurality of flexible panels supported on said cables and extending substantially from end cap to end cap with each of said panels forming one face of said trihedral member and carrying a portion of an advertising display.

2. The trihedral member as defined in claim 1 wherein said means for tensioning comprises a winch member associated with each cable member and mounted to said first end cap for independent rotation relative to said cable.

3. The trihedral member as defined in claim 2 wherein said first end cap comprises a triangular plate having equal sides, a shaft extending perpendicularly through said plate at the center thereof adapted for driven rotation about its longitudinal axis; a triangular support member mounted in spaced relation to said plate intermediate said plate and said holding means, with said winch member rotatably supported between said plate and support member; and guide members supported on said support member at the corners thereof to position at least one of said plurality of cables at the corner of said support member.

4. The trihedral member as defined in claim 2 wherein said tensioning means further comprises a plurality of tee spacers extending from said holding means at selected intervals to support and position said cables.

5. The trihedral member as defined in claim 1 further comprising means for illuminating said panels mounted with said means for holding.

6. The trihedral member as defined in claim 1 wherein said means for holding comprises a first, second and third elongated rigid member spaced parallel and equidistant to each other and extending normal to said first and second end caps and a plurality of brace members connecting said first, second and third elongated rigid members to each other.

7. The trihedral member as defined in claim 6 wherein said means for tensioning comprises a winch member associated with each cable member and mounted to said first end cap for independent rotation relative to said cable.

8. The trihedral member as defined in claim 7 wherein said first end cap comprises a plate having a shaft extending perpendicularly through said plate at the center thereof and adapted for driven rotation about its longitudinal axis; a support member mounted on said plate in spaced relation thereto intermediate said plate and said holding means, with said winch member rotatably supported between said plate and support member; and guide members supported on said support member at three equidistant corners thereof to position at least one of said plurality of cables at the corner of said support member.

9. An advertising display comprising a rigid frame supporting a plurality of rotatably mounted elongated display elements, each display element having a first and second axial stub shaft at each end, said stub shafts engaged by said frame and having a lightweight boom disposed between said stub shafts to hold said shafts in spaced relation; means affixed to said boom for supporting a set of inelastic cables in parallel spaced relation to said boom; a flexible panel supported on said cables longitudinally of said display elements, each panel being generally rectangular and substantially the length of said display elements to define a face of said display element; and means operatively connected to said first stub shaft for selectively rotating said display elements such that said faces are positioned in parallel with one third of said faces being co-planar.

10. The advertising display as defined in claim 9 wherein said means for supporting a set of inelastic cables comprises a first support member affixed to and extending perpendicular to said first stub shaft, a second support member affixed to said second stub shaft spaced from and parallel to said first support member; guide mans mounted equidistantly to the periphery of said second support member in a triangular pattern; means mounted between said first and second supporting members for individually engaging each cable of said set of cables to tension said cable within said guide means.

11. The advertising display as defined in claim 11 further comprising a plurality of T-shaped support members spaced apart and extending radially from said boom to align said cables.

12. The advertising display as defined in claim 9 further comprising means for illuminating said panels mounted internally of said display elements.

13. The advertising display as defined in claim 10 wherein said boom comprises first, second and third elongated tubular members co-parallel with said stub shafts and extending therebetween and a plurality of tubular brace elements interconnecting said elongated tubular members to form a rigid structure with said elongated tubular members spaced equidistantly from one another.

* * * * *